United States Patent [19]

Sharp

[11] Patent Number: 4,658,464

[45] Date of Patent: Apr. 21, 1987

[54] VACUUM/SHAMPOO APPARATUS

[76] Inventor: Leonard E. Sharp, 1304 Rosemond, Jonesboro, Ark. 72401

[21] Appl. No.: 844,302

[22] Filed: Mar. 26, 1986

[51] Int. Cl.[4] ..... A47L 7/00

[52] U.S. Cl. ..... 15/321; 15/339

[58] Field of Search ..... 15/320, 321, 322, 339

[56] References Cited

U.S. PATENT DOCUMENTS

| | | | |
|---|---|---|---|
| 3,815,169 | 6/1974 | Mooring | 15/321 |
| 4,153,968 | 5/1979 | Perkins | 15/321 |
| 4,159,544 | 7/1979 | Knight et al. | 15/321 |
| 4,194,262 | 3/1980 | Finley et al. | 15/321 X |
| 4,202,072 | 5/1980 | Gonzales | 15/321 X |

*Primary Examiner*—Chris K. Moore

*Attorney, Agent, or Firm*—Walker & McKenzie

[57] ABSTRACT

An apparatus for spraying a shampoo solution through a shampoo solution supply conduit to a nozzle as the nozzle is moved over an area of upholstery, carpet and the like while dirty shampoo solution is drawn back through the nozzle to a vacuum tank by vacuum suction. A mechanism is provided to apply the vacuum suction to the shampoo solution supply conduit at the end of the cleaning operation to effectively clear the shampoo solution supply conduit and nozzle of the shampoo solution.

15 Claims, 6 Drawing Figures

VACUUM/SHAMPOO APPARATUS

BACKGROUND OF THE INVENTION

The present invention relates in general to machines for simultaneously shampooing and vacuuming an area of carpet, upholstery and the like.

Heretofore, various such machines have been developed. See, for example, Finley et al, U.S. Pat. No. 4,194,262 which discloses a vacuum extraction cleaning machine adapted for coin operated applications and including an injector valve means to mix cleaning chemicals with incoming fresh water to yield the necessary cleaning solution.

Such machines are typically associated with do-it-yourself coin operated car washes and are normally positioned in an outdoor, exposed to the weather location. One common problem with such machines is the freezing of the shampoo or cleaning solution during cold weather. This problem is especially detrimental to the flexible hose which extends from the body of the machine to a remote nozzle or cleaning tool through which the shampoo or cleaning solution is sprayed.

The present inventor is aware of a shampoo/vacuum apparatus sold by Geoquip of 3141 S. Main, Ft. Worth, TX 76110 which includes means to purge liquid from the shampoo hose after usage and to heat the interior of the cabinet of the machine when temperature drops to or below 35° F. The method of purging liquid from the shampoo hose is merely to blow a quantity of air through the hose to thereby blow any liquid in the hose out through the nozzle or cleaning tool on the distal end thereof.

A preliminary patentability search in Class 137, subclasses 59, 60, 61 and 62, and Class 138 subclass 32 disclosed the following patents which relate in general to car washing apparatuses or means for preventing water lines and the like from freezing but which do not relate specifically to the vacuum/shampoo apparatus of the present invention: Sanford et al, U.S. Pat. No. 2,268,086; Ligon, U.S. Pat. No. 3,037,707; Cline, U.S. Pat. No. 3,276,628; Roach, U.S. Pat. No. 3,346,191; Shelton, U.S. Pat. No. 4,360,036; Perkins, U.S. Pat. No. 4,355,652; and Anderson, U.S. Pat. No. 4,481,966. None of the above patents or apparatuses disclose or suggest the present invention.

SUMMARY OF THE INVENTION

The present invention provides an improved vacuum/shampoo apparatus which can safely be positioned in an outdoor, exposed to the weather position year around regardless of temperature. The concept of the present invention is to combine the various components thereof in such a manner that the shampoo solution supply conduit thereof will automatically be coupled to the vacuum source thereof after the normal operation of the apparatus to apply suction thereto to evacuate any remaining shampoo solution from the shampoo solution supply pipe.

The vacuum/shampoo apparatus of the present invention comprises, in general, a nozzle member for being moved over an area of upholstery, carpet and the like to be cleaned during the cleaning operation; shampoo spray means coupled to the nozzle member for causing a shampoo solution to be sprayed through the nozzle onto the area to be cleaned; the shampoo spray means including a shampoo solution source and including a shampoo solution supply conduit coupled to the nozzle member; vacuum means coupled to the nozzle member for normally creating a vacuum at the nozzle member to draw the shampoo solution and any dirt from the area as the nozzle member is moved over the area, the vacuum means including a vacuum source and including a vacuum conduit coupled to the nozzle member; and valve means coupled to the shampoo solution source, the shampoo solution supply conduit, and the vacuum source for coupling the shampoo solution conduit to the shampoo solution source during the normal operation of the apparatus and for coupling the shampoo solution supply conduit to the vacuum source after the normal operation of the apparatus to create a vacuum in the shampoo solution supply conduit to draw all shampoo solution from the shampoo solution supply conduit.

BRIEF DESCRIPTION OF THE DRAWINGS

FIG. 1 is a perspective view showing the apparatus of the present invention being used to clean an area of upholstery, carpet or the like.

DESCRIPTION OF THE PREFERRED EMBODIMENT

The preferred embodiment of the vacuum/shampoo apparatus 11 of the present invention is for use as a self-service money operated device for cleaning an area A of upholstery, carpet and the like.

More specifically, the apparatus 11 is typically for use in connection with a self-service coin operated car wash in which the user thereof can clean the interior of an automobile or the like before or after the exterior of the automobile is washed.

Figure 1:
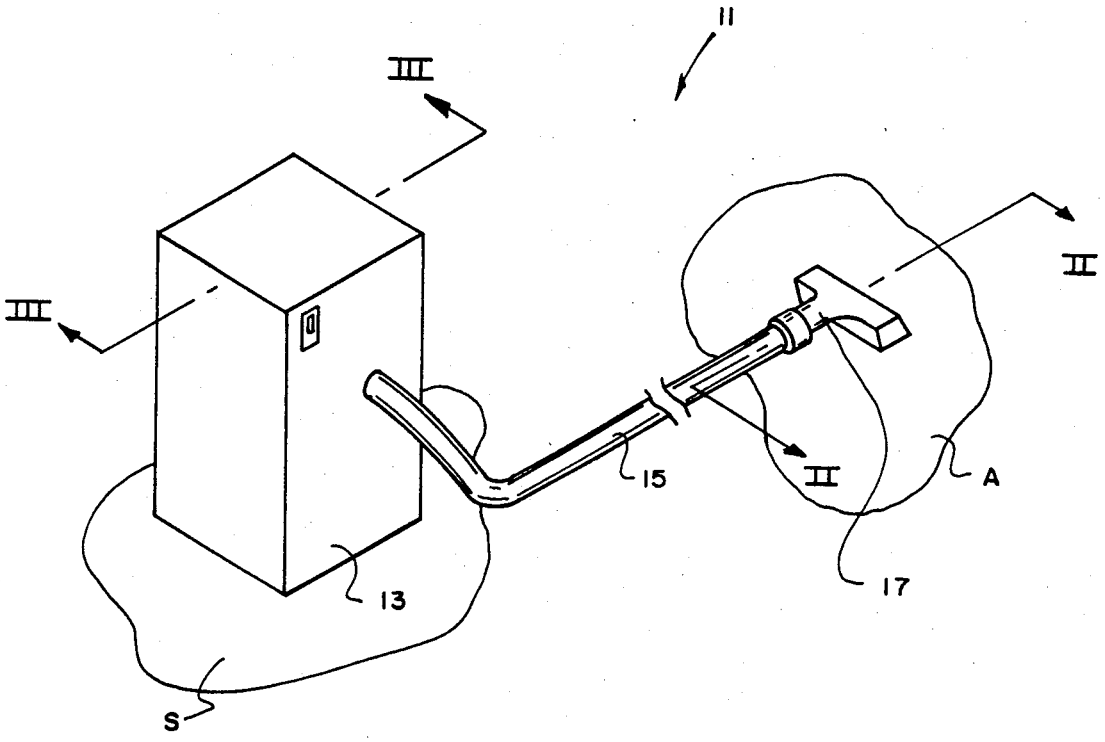

The apparatus 11 includes, in general, a body or housing member 13, an enlarged, flexible hose means 15 extending from the body 13 to a nozzle member 17 which is moved over the area A of upholstery, carpet and the like to be cleaned such as the interior of an automobile or the like (see FIG. 1).

The apparatus 11 includes a shampoo spray means coupled to the nozzle member 17 for causing a shampoo solution to be sprayed through the nozzle member 17 onto the area A. The shampoo spray means includes a shampoo solution source 23 and includes a shampoo solution supply conduit 25 coupled to the nozzle member 17 (see FIGS. 4 and 5).

The apparatus 11 includes a vacuum means coupled to the nozzle member 17 for normally creating a vacuum at the nozzle member 17 to draw the shampoo solution and any dirt from the area 19 as the nozzle member 17 is moved over the area A. The vacuum means includes a vacuum source 27 and includes a vacuum conduit 29 coupled to the nozzle member 17 (see FIGS. 4 and 5).

Figure 4:
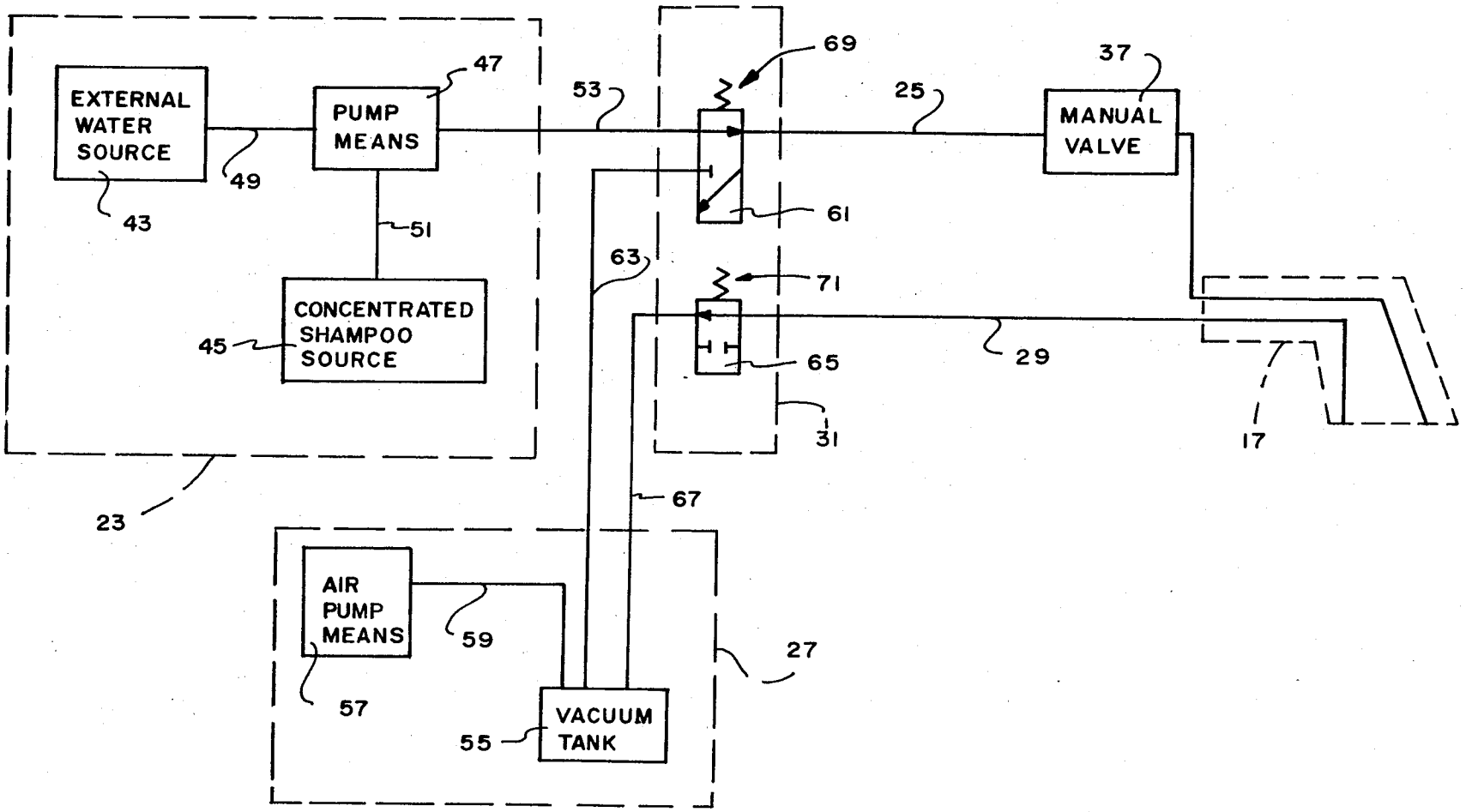
FIG. 4 is a somewhat diagrammatic view of the apparatus of the present invention showing the first and second solenoids therein electrically energized.
Figure 5:
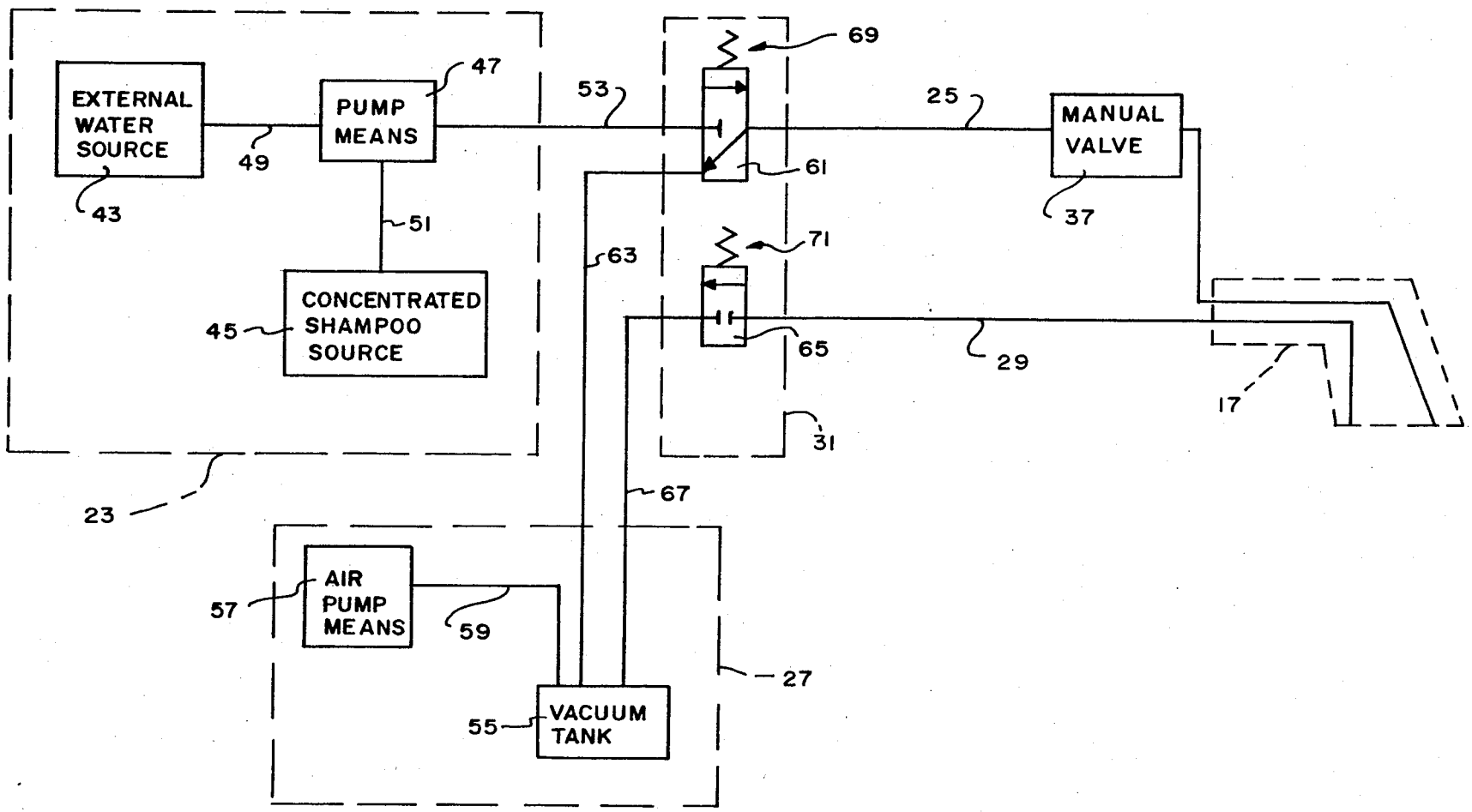
FIG. 5 is similar to FIG. 4 but shows the first and second solenoids electrically de-energized.

The apparatus 11 includes a valve means 31 coupled to the shampoo solution source 23, the shampoo solution supply conduit 25, and to the vacuum source 27 for coupling the shampoo solution supply conduit 25 to the shampoo solution source 23 during the normal operation of the apparatus 11 and for coupling the shampoo solution supply conduit 25 to the vacuum source 27 after the normal operation of the apparatus 11 to draw the shampoo solution from the shampoo solution supply conduit 25 (see FIGS. 4 and 5). By so drawing any remaining shampoo from the shampoo solution supply conduit 25 after the normal operation of the apparatus 11, any possible damage to the shampoo solution supply conduit 25 which might occur due to freezing weather or the like will be prevented.

Figure 2:
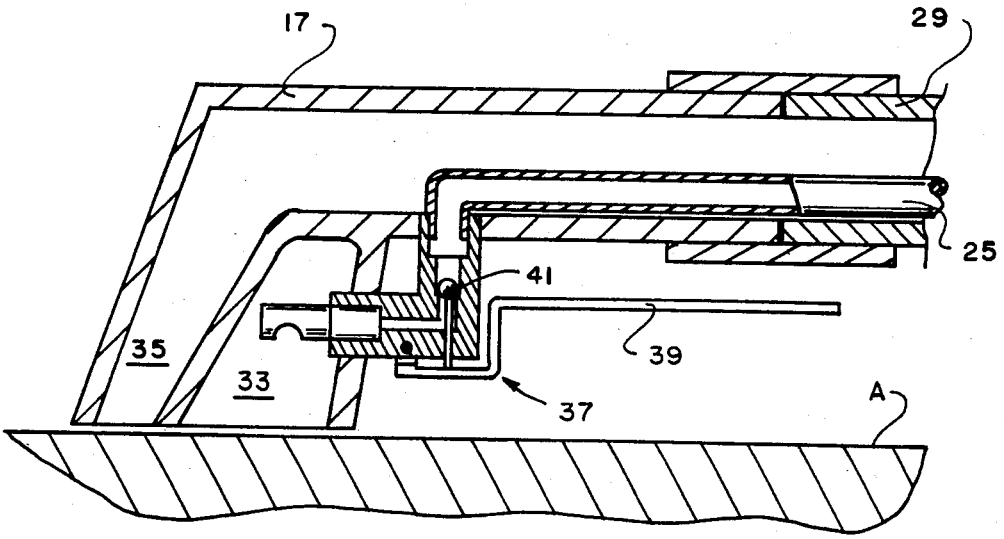
FIG. 2 is an enlarged sectional view substantially as taken on line II—II of FIG. 1.

The nozzle member 17 preferably includes a first port 33 communicating with the shampoo solution supply conduit 25 for allowing the shampoo solution to be sprayed therefrom and preferably includes a second port 35 communicating with the vacuum conduit 29 for allowing dirt and the shampoo solution to be drawn therethrough (see FIG. 2). The specific construction of the nozzle member 17 may vary as will be apparent to those skilled in the art. Thus, the nozzle member 17 may be molded out of plastic or the like.

The apparatus 11 preferably includes a manual valve 37 positioned between the first port 33 of the nozzle member 17 and the shampoo solution supply conduit 25 or interposed within the shampoo solution supply conduit 25 for allowing the user of the apparatus 11 to selectively allow the shampoo solution to be sprayed from the first port 33. The manual valve 37 may consist of various types as will be apparent to those skilled in the art. Thus, the manual valve 37 may consist of a ball-type check valve that is normally held in the closed position by the pressure of the shampoo solution in the shampoo solution supply conduit 25 and that includes a lever 39 coupled to a ball 41 in such a manner that movement of the lever 39 by the user of the apparatus 11 will cause the ball 41 to move to an open position allowing shampoo solution to flow from the shampoo solution supply conduit 25 through the manual valve 37 and out the first port 33 of the nozzle member 17 (see FIG. 2).

The hose means 15 is defined by the shampoo solution supply conduit 25 and the vacuum conduit 29. The shampoo solution supply conduit 25 may be positioned within the vacuum conduit 29 in a substantially coaxial manner, etc., as will now be apparent to those skilled in the art.

The shampoo solution source 23 preferably includes an external water source 43 such as a connection to a typical pressurized water main or the like, a concentrated shampoo supply source 45 such as a tank for holding a volume of concentrated shampoo, a pump means 47 for mixing concentrated shampoo from the concentrated shampoo supply source 45 and water from the external water source 43 and for pumping the mixture to the valve means 31, through the shampoo solution supply conduit 25 to the manual valve 37, and out the first port 33 of the nozzle member 17 (see FIGS. 4 and 5). The pump means 47 may consist of a typical electric pump member having a first inlet port coupled to the external water source 43 by way of a conduit 49 or the like, having a second inlet port coupled to the concentrated shampoo supply source 45 by way of a conduit 51 or the like, and having an outlet port coupled to the valve means 31 by a conduit 53 or the like.

The vacuum source 27 preferably includes a vacuum tank 55 such as a hollow polyvinyl chloride tank or the like, and an air pump means 67 for pumping air from the vacuum tank 55 to create a vacuum therein (see FIGS. 4 and 5). The air pump 57 may be of any typical electrical air pump well known to those skilled in the art having an inlet port coupled to the vacuum tank 55 by way of a conduit 59 or the like.

The valve means 31 preferably includes a shampoo solution/vacuum valve member 61 coupled to the shampoo solution source 23 by way of the conduit 53 extending from the outlet port of the pump means 47, to the vacuum source 27 by way of a conduit 63 or the like extending from the vacuum tank 55, and to the shampoo solution supply conduit 25 (see FIGS. 4 and 5). The shampoo solution/vacuum valve member 61 is movable between a first position for providing open communication between the shampoo solution source 23 and the shampoo solution supply conduit 25 while blocking communication between the vacuum source 27 and the shampoo solution supply conduit 25, and a second position for providing open communication between the vacuum source 27 and the shampoo solution supply conduit 25 while blocking communication between the shampoo solution source 23 and the shampoo solution supply conduit 25.

The valve means 31 preferably includes a vacuum valve member 65 coupled to the vacuum source 27 by way of a conduit 67 or the like extending from the vacuum tank 55, and to the vacuum conduit 29 (see FIGS. 4 and 5). The vacuum valve member 65 is movable between a first position for providing open communication between the vacuum source 27 and the vacuum conduit 29, and a second position for blocking communication between the vacuum source 27 and the vacuum conduit 29.

Figure 6:
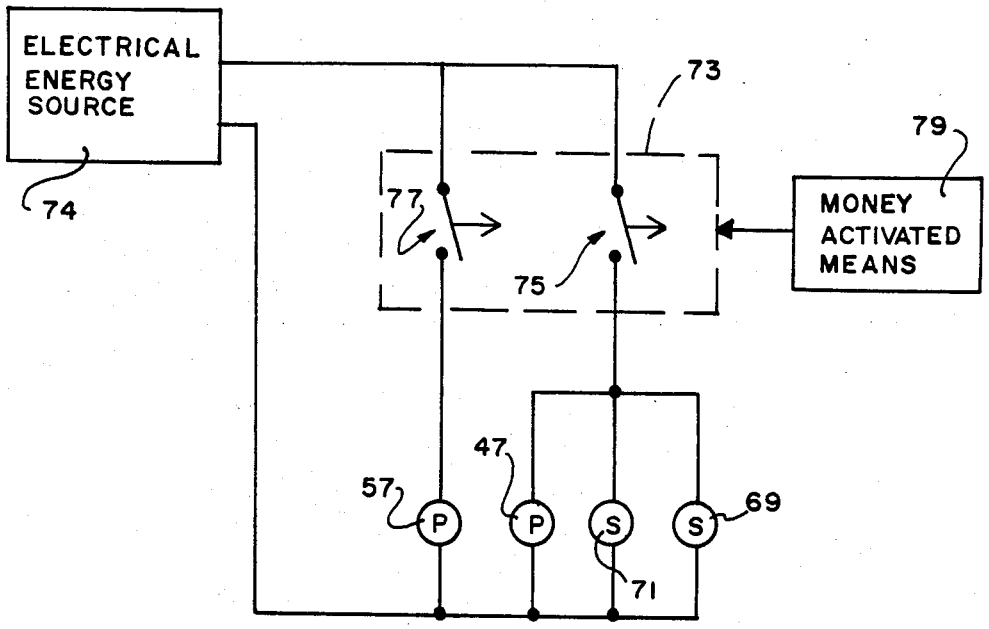
FIG. 6 is an electrical schematic view of the apparatus of the present invention.

The apparatus 11 preferably includes a first solenoid 69 for moving the shampoo solution/vacuum valve member 61 between the first and second positions and a second solenoid 71 for moving the vacuum valve member 65 between the first and second positions (see FIGS. 4, 5 and 6). The first solenoid 69 is coupled to the shampoo solution/vacuum valve member 61 in a manner which will move the shampoo solution/vacuum valve member 61 to the first position when the first solenoid 69 is electrically energized and to the second position when the first solenoid 69 is electrically de-energized. Similarly, the second solenoid 71 is coupled to the vacuum valve member 65 in such a manner so as to move the vacuum valve member 65 to the first position when the second solenoid 71 is electrically energized and to the second position when the second solenoid 71 is electrically de-energized.

The apparatus 11 preferably includes a timing circuit means 73 coupled to an electrical energy source 74 (see FIG. 6) for selectively electrically energizing the first solenoid 69, the second solenoid 71, the pump means 47, and the air pump means 57. The timing circuit means 73 is preferably adapted to cause the air pump means 57 to remain electrically energized for a period of time (e.g., 15 seconds) after the first and second solenoids 69, 71 have been electrically de-energized. The timing circuit means 73 preferably includes a first timer switch means 75 electrically coupled to the first and second solenoids 69, 71 and the pump means 47 for electrically energizing the first and second solenoids 69, 71 and the pump means 47 when closed. The timing circuit means 73 also preferably include a second timer switch means 77 electrically coupled to the air pump means 57 for electrically energizing the air pump means 57 when closed. The specific construction and operation of the timing circuit means 73 may vary in any manner now apparent to those skilled in the art. The second timer switch means 77 is preferably adapted to remain closed for a period of time (e.g., 15 seconds) after the first timer switch means 75 opens. While the specific length of time the first timer switch means 75 remains closed is optional, a typical length of time is 5 minutes.

The apparatus 11 preferably includes a money activated means 79 for causing the first and second timer switch means 75,77 to close (see FIG. 6). Thus, the money activated means 79 may be of any typical construction well known to those skilled in the art whereby the user of the apparatus 11 deposits a pre-selected amount of money thereinto to thereby activate the timing circuit means 73 and close the first and second switch means 75, 77.

Figure 3:
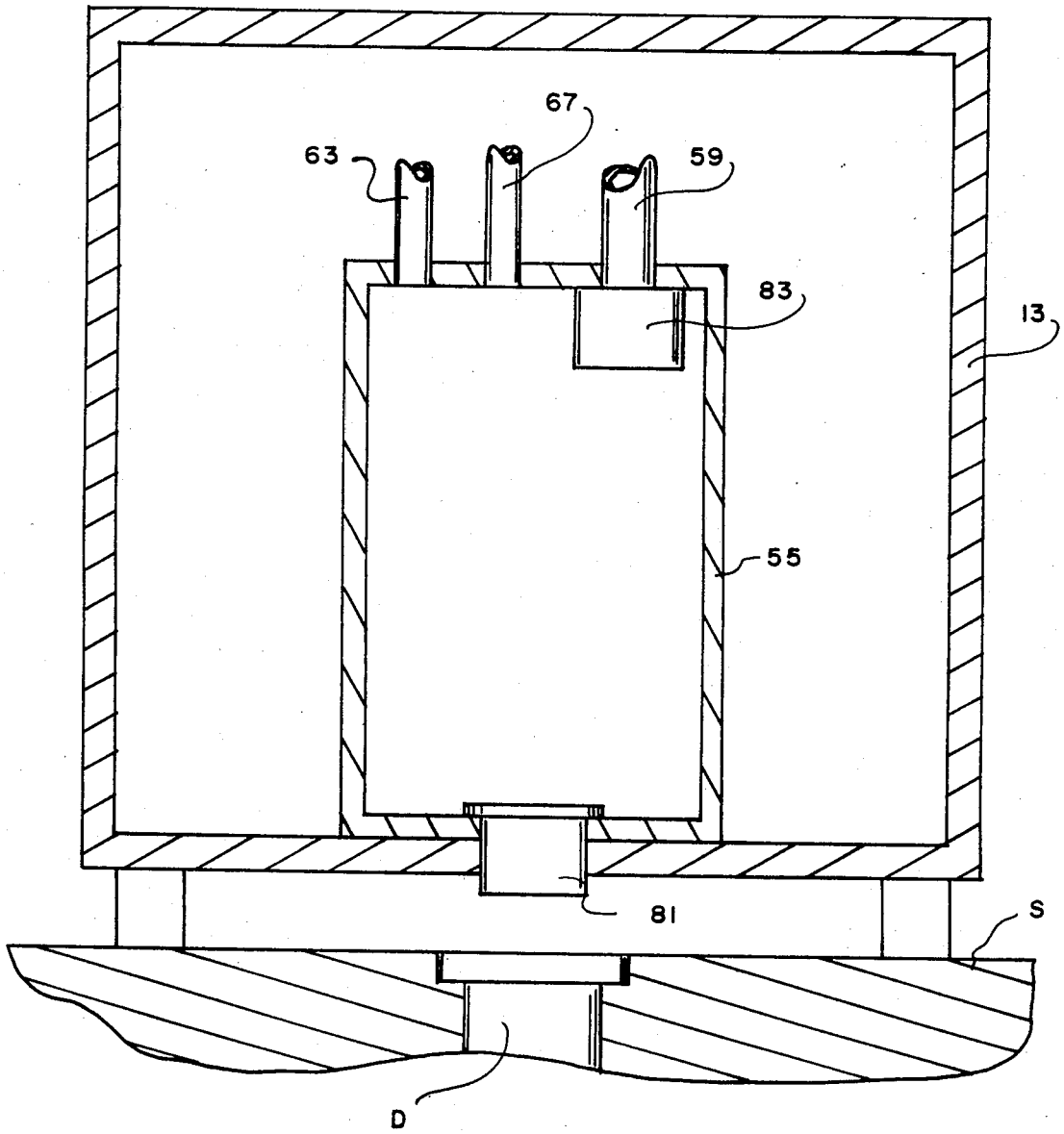
FIG. 3 is an enlarged sectional view substantially as taken on line III—III of FIG. 1 showing the vacuum tank and associated structure of the apparatus of the present invention and with other components thereof removed for clarity.

The apparatus 11 preferably includes a sump check valve 81 attached to the vacuum tank 55 for allowing the contents of the vacuum tank 45 to drain therefrom when the air pump means 57 is electrically de-energized (see FIG. 3). The sump check valve 81 may be of any typical construction and operation well known to those skilled in the art. Thus, for example, the sump check valve 81 may consist of a ball-type check valve which will remain closed as along as there is a negative pressure within the vacuum tank 55 and which will automatically open when there is no longer a negative pressure within the vacuum tank 55. The apparatus 11 may be supported on a support surface S having a drain D located under the sump check valve 81 (see FIG. 3). The drain D may be connected to a typical sewer line or the like as will now be apparent to those skilled in the art.

The apparatus 11 preferably includes a check valve 83 located within the vacuum tank 55 and coupled to the conduit 59 for preventing the air pump means 57 from pumping fluid from the vacuum tank 55 while allowing the air pump means 57 to pump air from the vacuum tank 55 (see FIG. 3). The check valve 83 may be of the float type well known to those skilled in the art in which a floating ball or the like will close the inlet to the conduit 59 if the fluid within the vacuum tank 55 rises to a certain level.

Although the invention has been described and illustrated with respect to a preferred embodiment thereof and a preferred use therefore, it is not to be so limited since changes and modifications can be made therein which are within the full intended scope of the invention.

I claim:

1. A vacuum/shampoo apparatus for cleaning an area of upholstery, carpet and the like, said apparatus comprising in combination;

(a) a nozzle member for being moved over said area during the cleaning operation;

(b) shampoo spray means coupled to said nozzle member for causing a shampoo solution to be sprayed through said nozzle onto said area, said shampoo spray means including a shampoo solution source and including a shampoo solution supply conduit coupled to said nozzle member;

(c) vacuum means coupled to said nozzle member for normally creating a vacuum at said nozzle member to draw said shampoo solution and any dirt from said area as said nozzle member is moved over said area, said vacuum means including a vacuum source and including a vacuum conduit coupled to said nozzle member; and (d) valve means coupled to said shampoo solution source, to said shampoo solution supply conduit and to said vacuum source for coupling said shampoo solution supply conduit to said shampoo solution source during the normal operation of said apparatus and for coupling said shampoo solution supply conduit to said vacuum source after the normal operation of said apparatus to draw said shampoo solution from said shampoo solution supply conduit.

2. The apparatus of claim 1 in which said shampoo solution source includes an external water source, a concentrated shampoo supply source, and a pump means for mixing concentrated shampoo from said concentrated shampoo supply source and water from said external water source and pumping the mixture to said valve means.

3. The apparatus of claim 2 in which said vacuum source includes a vacuum tank and an air pump means for pumping air from said vacuum tank to create a vacuum therein.

4. The apparatus of claim 3 in which said vacuum tank includes a sump check valve for allowing the contents of said vacuum tank to drain therefrom when said air pump means is electrically de-energized.

5. The apparatus of claim 1 in which said valve means includes a shampoo solution/vacuum valve member coupled to said shampoo solution source, to said vacuum source, and to said shampoo solution supply conduit; said shampoo solution/vacuum valve member being movable between a first position for providing open communication between said shampoo solution source and said shampoo solution supply conduit while blocking communication between said vacuum source and said shampoo solution supply conduit, and a second position for providing open communication between said vacuum source and said shampoo solution supply conduit while blocking communication between said shampoo solution source and said shampoo solution supply conduit.

6. The apparatus of claim 5 in which said valve means includes a vacuum valve member coupled to said vacuum source and to said vacuum conduit; said vacuum valve member being movable between a first position for providing open communication between said vacuum source and said vacuum conduit and a second position for blocking communication between said vacuum source and said vacuum conduit.

7. The apparatus of claim 6 in which is included a first solenoid for moving said shampoo solution/vacuum valve member between said first and second positions and a second solenoid for moving said vacuum valve member between said first and second positions.

8. The apparatus of claim 7 in which said first solenoid will move said shampoo solution/vacuum valve member to said first position when electrically energized and to said second position when electrically de-energized.

9. The apparatus of claim 8 in which said second solenoid will move said vacuum valve member to said first position when electrically energized and to said second position when electrically de-energized.

10. The apparatus of claim 9 in which is included a timing circuit means for selectively electrically energizing said first solenoid, said second solenoid, said shampoo solution pump means, and said air pump means.

11. The apparatus of claim 10 in which said timing circuit means causes said air pump means to remain electrically energized for a period of time after said first and second solenoids have been electrically de-energized.

12. The apparatus of claim 10 in which said tiing circuit means includes a first timer switch means for electrically energizing said first solenoid, said second solenoid and said shampoo solution pump means when closed; and in which said timing circuit switch means includes a second timer switch means for electrically energizing said air pump means when closed.

13. The apparatus of claim 12 in which said second timer switch means remains closed for a period of time after said first timer switch means opens.

14. The apparatus of claim 13 in which is included a money activated means for causing said first and second timer switch means to close.

15. The apparatus of claim 1 in which said nozzle member includes a manual valve for controlling the exit of said shampoo solution from said nozzle member.

* * * * *